US009172172B2

(12) United States Patent
Shindo et al.

(10) Patent No.: US 9,172,172 B2
(45) **Date of Patent: *Oct. 27, 2015**

(54) CONNECTOR

(71) Applicant: J.S.T. MFG. CO., LTD., Osaka-shi (JP)

(72) Inventors: Satoru Shindo, Miyoshi (JP); Shinji Tasaka, Miyoshi (JP); Takamasa Yagi, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/249,583

(22) Filed: Apr. 10, 2014

(65) Prior Publication Data

US 2014/0308851 A1 Oct. 16, 2014

(30) Foreign Application Priority Data

Apr. 12, 2013 (JP) ..... 2013-084180

(51) Int. Cl.

| | |
|---|---|
| ***H01R 13/64*** | (2006.01) |
| ***H01R 13/46*** | (2006.01) |
| ***H01R 13/629*** | (2006.01) |
| ***H01R 13/631*** | (2006.01) |
| ***H01R 43/26*** | (2006.01) |

(Continued)

(52) U.S. Cl.

CPC ..... *H01R 13/46* (2013.01); *H01R 13/629* (2013.01); *H01R 13/631* (2013.01); *H01R 43/26* (2013.01); *H01R 12/716* (2013.01); *H01R 13/4538* (2013.01); *H01R 13/5045* (2013.01)

(58) Field of Classification Search

CPC ..... H01R 13/631

USPC ..... 439/263, 381, 380, 374, 136, 137

See application file for complete search history.

(56) References Cited

U.S. PATENT DOCUMENTS 6,004,140 A * 12/1999 Kato et al. ..... 439/65
6,146,184 A * 11/2000 Wilson et al. ..... 439/374

(Continued)

FOREIGN PATENT DOCUMENTS

JP 10-308570 A 11/1998
JP 11-144806 A 5/1999

(Continued)

OTHER PUBLICATIONS

Extended European Search Report issued May 14, 2014 in counterpart application No. 14154609.3.

(Continued)

*Primary Examiner* — Phuong Dinh

(74) *Attorney, Agent, or Firm* — Kratz, Quintos & Hanson, LLP

(57) ABSTRACT

A guide connector includes a first movable body, a second movable body, a box-like body capable of accommodating the movable bodies, and a lid. The guide connector is positioned below a substrate. Contacts are inserted into a female connector after passing through contact insertion holes to of the guide connector and penetrating the substrate. After the electrical connection between the contacts and female contacts are respectively established, a slider is pressed down, which causes pressing pins and to press the first movable body and the second movable body. With this, a lower stage of the first movable body and a lower stage of the second movable body detach from restriction beams. This allows springs to extend, to move the first movable body and the second movable body away from the contacts.

19 Claims, 11 Drawing Sheets

(51) Int. Cl.

| | |
|---|---|
| *H01R 12/71* | (2011.01) |
| *H01R 13/453* | (2006.01) |
| *H01R 13/504* | (2006.01) |

(56) References Cited

U.S. PATENT DOCUMENTS

| | | | | |
|---|---|---|---|---|
| 6,672,908 | B2 * | 1/2004 | Okabe et al. | 439/682 |
| 2003/0188882 | A1 | 10/2003 | Asao et al. | |
| 2014/0273603 | A1 * | 9/2014 | Shindo et al. | 439/374 |
| 2014/0308851 | A1 * | 10/2014 | Shindo et al. | 439/625 |

FOREIGN PATENT DOCUMENTS

| | | | |
|---|---|---|---|
| JP | 2010-146873 | A1 | 7/2010 |
| WO | 2009/111567 | A2 | 9/2009 |

OTHER PUBLICATIONS

Extended European Search Report issued Jul. 4, 2014 in counterpart application No. 14164142.3.

Extended European Search Report issued Jul. 4, 2014 in counterpart application No. 14164141.5.

* cited by examiner

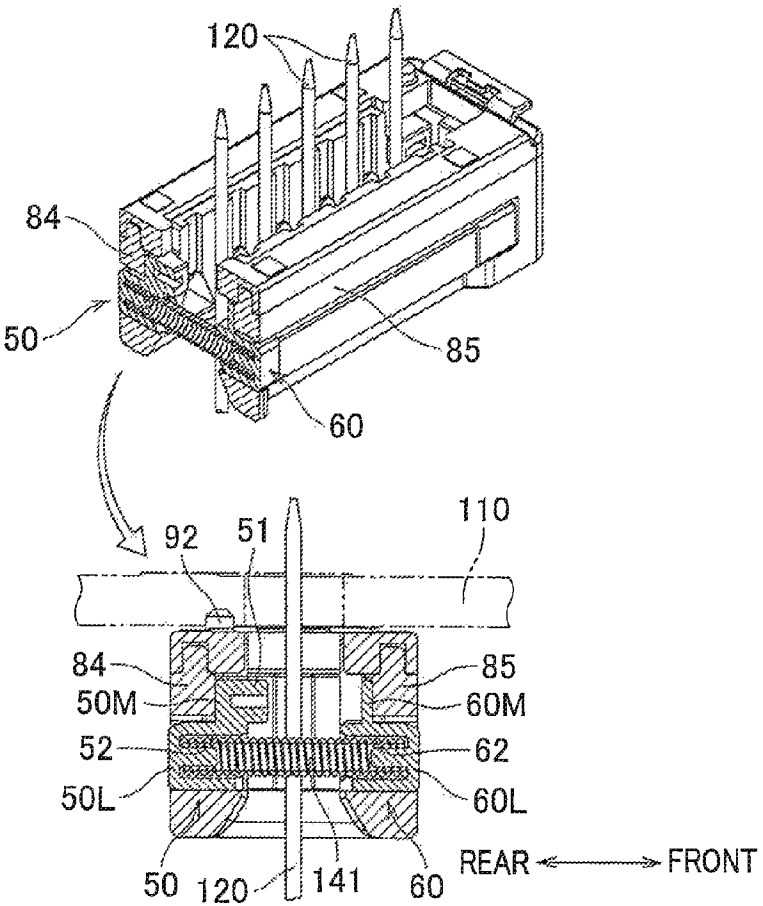
FIG.5B SEPARATED STATE
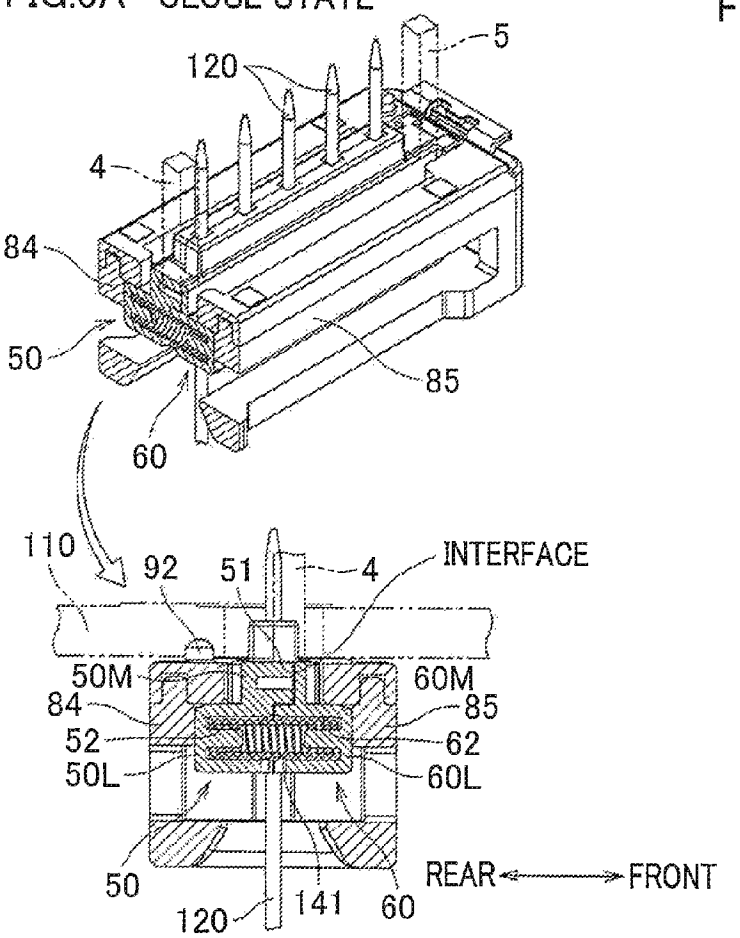
FIG.5A CLOSE STATE

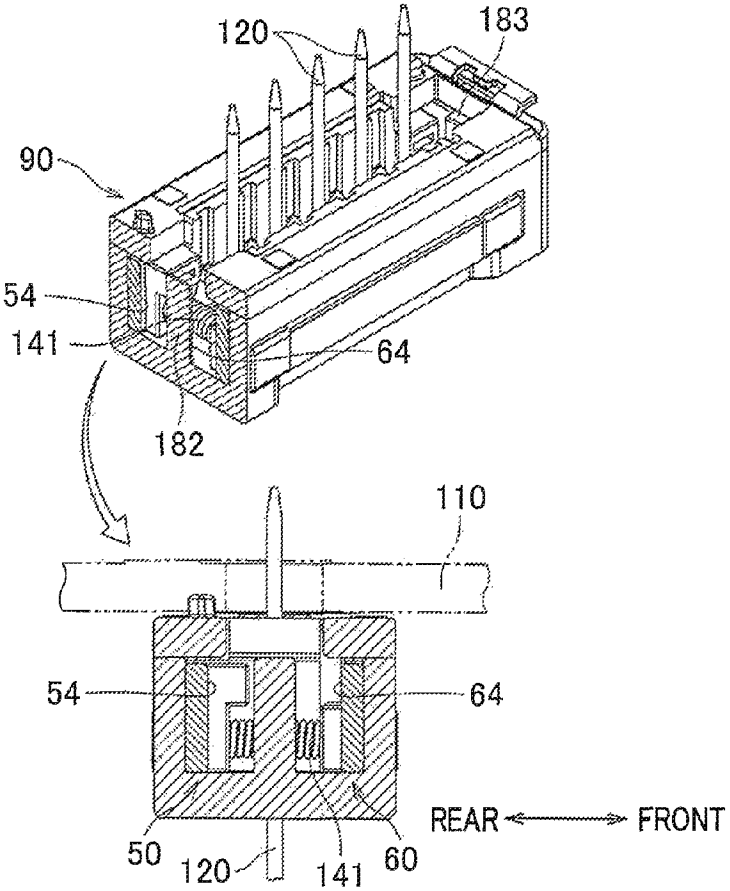
FIG.6B SEPARATED STATE
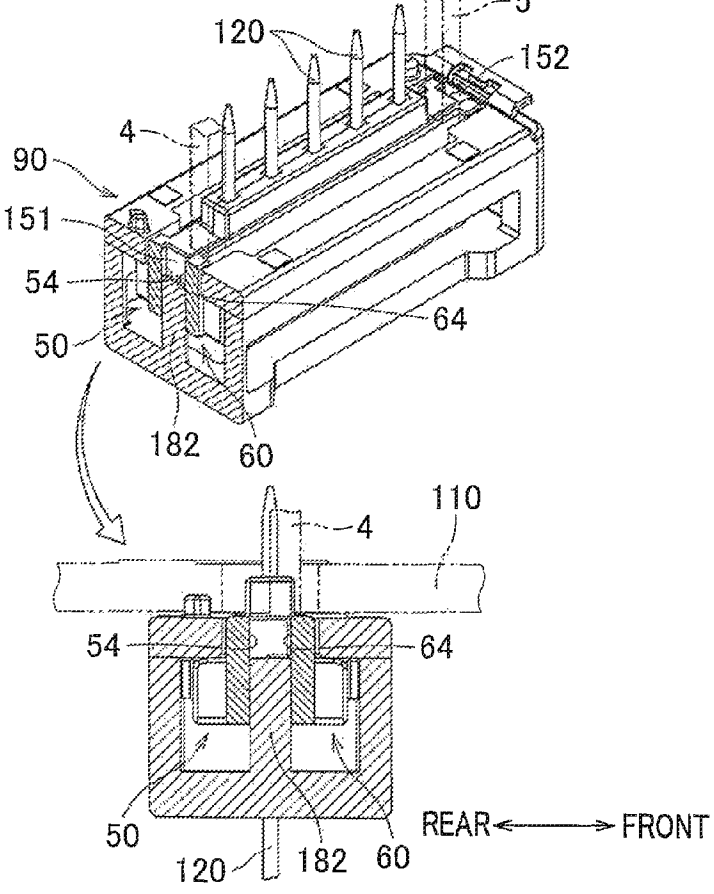
FIG.6A CLOSE STATE 50
60
60L
50L
85
80
80a
84
90
50
60
50L
80
132
60
S2
50
90
131
S1
80
132
60
90
131
50
80

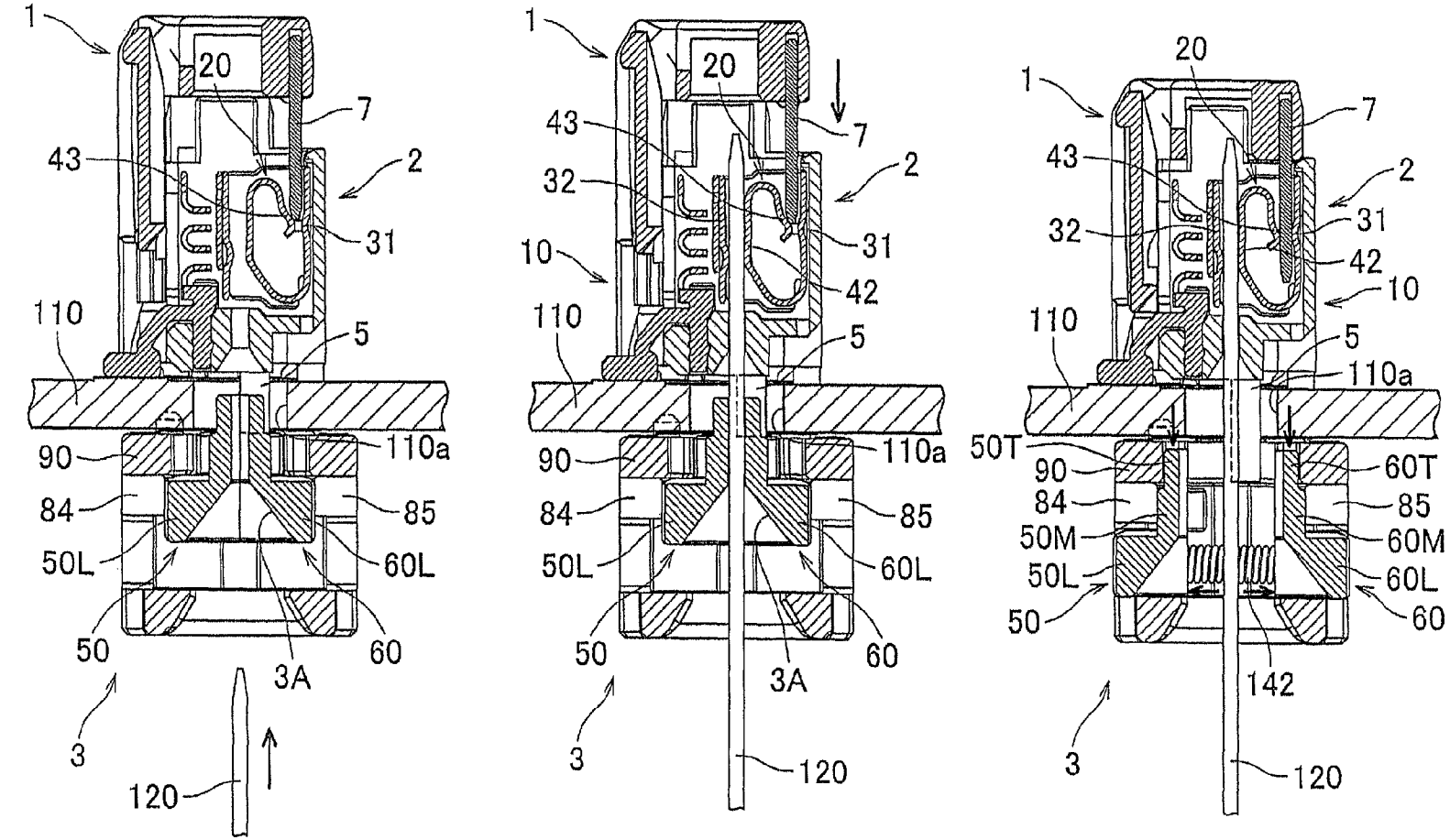
FIG.11A CLOSE STATE
FIG.11B CLOSE STATE
FIG.11C SEPARATED STATE

CONNECTOR

CROSS REFERENCE TO RELATED APPLICATION

This application claims priority from Japanese Patent Application No. 2013-084180, which was filed on Apr. 12, 2013, the disclosure of which is herein incorporated by reference in its entirety.

BACKGROUND OF THE INVENTION

1. Field of the Invention

The present invention relates to a connector including a housing configured to guide a contact into a contact insertion hole formed through a substrate.

2. Description of Related Art

As a connector mounted in an automobile or the like, there has been known a connector configured to be placed on a substrate, into which connector a counterpart contact is inserted from below through the substrate. The counterpart contact is inserted into the connector after passing through a contact insertion hole formed through the substrate. If there is misalignment between the counterpart contact and the contact insertion hole due to the tolerance or the like at the time of manufacturing, the counterpart contact cannot be smoothly inserted into the contact insertion hole. Such a problem becomes a more significant concern, with an increase in the number of counterpart contacts.

To address this problem, Japanese Unexamined Patent Publication No. 146873/2010 (Tokukai 2010-146873: Patent Literature 1) discloses a guide housing configured to guide a counterpart contact into a contact insertion hole. The guide housing has a guide hole (through hole) into which the counterpart contact is able to be inserted. When the guide housing is positioned below the substrate, the guide hole is located below the contact insertion hole, and these holes communicate with each other. The guide hole has a funnel-like shape such that its diameter increases with an increase in the distance from the contact insertion hole. The diameter at the lower end of the guide hole is larger than the diameter of the contact insertion hole. Therefore, even if there is misalignment between the counterpart contact and the contact insertion hole due to tolerance or the like at the time of manufacturing, the counterpart contact is inserted into the guide hole, and then guided to the contact insertion hole.

SUMMARY OF THE INVENTION

In the above guide housing, the diameter of the upper end of the guide hole is substantially the same as the diameter of the counterpart contact. This facilitates guiding of the counterpart contact inserted in the guide hole to the contact insertion hole. While the counterpart contact is in the guide hole, the counterpart contact is close to an inner circumferential surface of the guide housing, which surface defines the guide hole.

Areas at or nearby a power supply and a source of power (such as an engine) for an automobile, where a connector is mounted, are likely to be subjected to vibration. This vibration may vibrate the guide housing, which causes the inner circumferential surface of the guide housing to contact the counterpart contact, leading to wear of the counterpart contact. Further, if the substrate is vibrated in addition to the guide housing to cause resonance, the stress to the counterpart contact is increased. As a result, the counterpart contact may be damaged.

In view of the above problem, an object of the present invention is to provide a connector capable of preventing wear of and damage to a counterpart contact.

According to one aspect of the present invention, a connector includes: a first connector and a second connector which are configured to be disposed across a substrate from each other; and a pressing member.

The first connector includes a first housing accommodating first and second movable bodies configured to be located across a first contact from each other, the first contact extending in a direction orthogonal to the substrate, and a biasing member configured to bias the first and second movable bodies in directions away from each other.

The first and second movable bodies accommodated in the first housing are configured to make a transition from a close state to a separated state, the close state being a state in which the first and second movable bodies are biased by the biasing member and movement of the first and second movable bodies in the directions away from each other is restricted by the first housing, the separated state being a state in which the first and second movable bodies are more distant from the second connector than in the close state and the first and second movable bodies are made more distant from each other than in the close state by the biasing member.

The first and second movable bodies define a contact insertion hole in the close state, the contact insertion hole having a smallest diameter not smaller than a diameter of the first contact and including a section whose diameter decreases toward the substrate.

The first housing includes a first accommodating member and a second accommodating member which are separable from each other, and the first housing is capable of accommodating the first and second movable bodies so that the first and second movable bodies are positioned in the close state through a process of combining the first and second accommodating members with each other.

The second connector includes a second housing and a second contact mounted in the second housing, the second contact configured to be electrically connected to the first contact passing through the contact insertion hole and penetrating the substrate.

The pressing member is configured to press at least one of the first and second movable bodies after the first contact passes through the contact insertion hole and penetrates the substrate and after the electric connection between the first contact and the second contact is established, thereby to cause the first, and second movable bodies to make the transition from the close state to the separated state.

In the first aspect of the present invention, at least one of the first and second movable bodies is pressed after the electric connection between the first contact and the second contact is established, and thereby the two movable bodies are moved away from the first contact. Therefore, even if the first housing is vibrated, or even if the first housing and the substrate are vibrated to cause resonance, wear of and damage to the first contact are prevented. Further, the first movable body and the second movable body are placed in the close state in the process of combining the first accommodating member and the second accommodating member, and therefore the first connector is assembled easily.

In the first aspect of the present invention, it is preferable that the first and second accommodating members are separable from each other in the direction orthogonal to the substrata. This facilitates assembling.

Further, it is preferable that, in the close state, the first and second movable bodies are in contact with either one of the first accommodating member and the second accommodating member. In this structure, the first housing is assembled simply by combining one of the accommodating members (an accommodating member accommodating therein the first movable body and the second movable body in the close state) with the other accommodating member.

Furthermore, it is preferable that one member out of the first accommodating member and the second accommodating member includes a protrusion protruding toward the other member, and the other member includes a recess into which the protrusion is fitted. The protrusion and the recess facilitate alignment between the first accommodating member and the second accommodating member when the first accommodating member and the second accommodating member are combined with each other.

Furthermore, it is preferable that the recess includes a smaller diameter portion which causes the recess to at least partially have a diameter shorter than an outer diameter of the protrusion before the protrusion is fitted into the recess. With this structure, the protrusion is tightly fitted into the recess, and therefore the second accommodating member is firmly secured to the first accommodating member. Furthermore, shavings generated when the protrusion is fitted into the recess and scrapes the smaller diameter portion of the recess are held at the bottom of the recess. As a result, the second accommodating member is fitted to the first accommodating member without a gap therebetween, thereby preventing entry of foreign matter into the first housing, and the second accommodating member is more firmly secured to the first accommodating member.

In addition, it is preferable that the smaller diameter portion is a plane opposing at least a part of a side circumferential surface which is a side surface of the recess. With this, the smaller diameter portion is formed on the recess.

Furthermore, it is preferable that: the first housing includes a slit formed across the first accommodating member and the second accommodating member; the connector further includes an insertion member inserted into the slit in the direction orthogonal to the substrate from the first accommodating member toward the second accommodating member; and the insertion member inserted into the slit includes a first pressing portion and at least one of a second pressing portion and an opposing portion, the first pressing portion pressing the second accommodating member in a direction crossing an insertion direction in which the insertion member is inserted, the second pressing portion pressing the first accommodating member in a direction crossing the insertion direction, the opposing portion opposing the first accommodating member in the insertion direction and being in contact with the first accommodating member.

In the above structure, as the insertion member is inserted into the slit, the first pressing portion presses the first accommodating member and the second pressing portion presses the second accommodating member. Further, the opposing portion and the first accommodating member sandwich the second accommodating member. With this, the second accommodating member is firmly secured to the first accommodating member.

According to another aspect of the present invention, a connector includes: a first housing accommodating first and second movable bodies configured to be located across a first contact from each other, the first contact extending in a direction orthogonal to a substrate; and a biasing member configured to bias the first and second movable bodies in directions away from each other.

The first and second movable bodies accommodated in the first housing are configured to make a transition from a close state to a separated state, the close state being a state in which the first and second movable bodies are biased by the biasing member and movement of the first and second movable bodies in the directions away from each other is restricted by the first housing, the separated state being a state in which the first and second movable bodies are made more distant from each other than in the close state by the biasing member.

The first and second movable bodies define a contact insertion hole in the close state, the contact insertion hole having a smallest diameter not smaller than a diameter of the first contact and including a section whose diameter decreases toward the substrate.

The first housing includes a first accommodating member and a second accommodating member which are separable from each other, and the first housing is capable of accommodating the first and second movable bodies so that the first and second movable bodies are positioned in the close state through a process of combining the first and second accommodating members with each other.

This structure enables the two movable bodies to be moved away from the first contact, and therefore, even if the first housing is vibrated, or even if the first housing and the substrate are vibrated to cause resonance, wear of and damage to the first contact are prevented. Further, the first movable body and the second movable body are placed in the close state in the process of combining the first accommodating member and the second accommodating member, and therefore the first connector is assembled easily.

According to an embodiment of the present invention, after the first contact passes through the contact insertion hole of the first housing and penetrates the substrate, the two movable bodies defining the contact insertion hole are moved away from the first contact. This prevents wear of and damage to the first contact even if the first housing is vibrated, or even if the first housing and the substrate are vibrated to cause resonance. Further, the connector is assembled easily.

BRIEF DESCRIPTION OF THE DRAWINGS

FIG. 5A includes a perspective view and a sectional view of the guide connector in a close state. FIG. 5B includes a perspective view and a sectional view of the guide connector in a separated state.

FIG. 6A includes another perspective view and another sectional view of the guide connector in the close state. FIG. 6B includes another perspective view and another sectional view of the guide connector in the separated state.

FIGS. 11A to 11C are sectional views of the connector, showing a sequence of assembling the connector.

DESCRIPTION OF THE PREFERRED EMBODIMENTS

[First Embodiment]

The following describes a first embodiment of the present invention.

Figure 1:
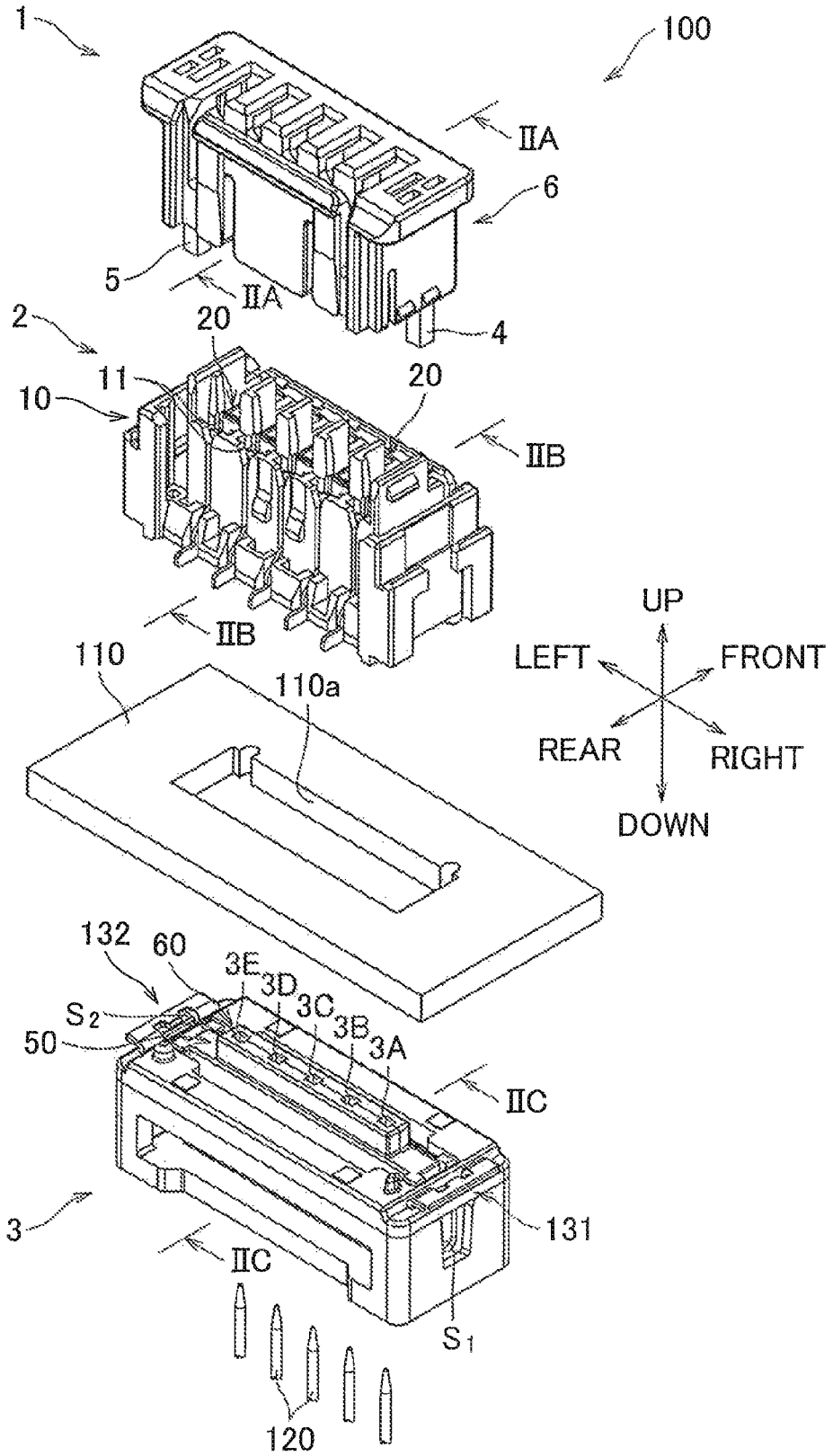
FIG. 1 is an exploded perspective view of a connector of a first embodiment of the present invention.

As shown in FIG. 1, a connector 100 includes a slider 1 and a female connector (a second connector) 2 to be positioned above a substrate 110, and a guide connector (a first connector) 3 to be positioned below the substrate 110. Into the guide connector 3, contacts (a first contact) 120 are inserted from below the guide connector 3. The slider 1 includes pressing pins (a pressing member) 4 and 5 each extending in up/down directions. The pressing pins 4 and 5 are respectively attached to right and left end portions of the slider 1.

The substrate 110 has a substantially quadrangular insertion hole 110*a*, which is a through hole in a direction of the thickness of the substrate 110. In the insertion hole 110*a*, an upper end portion of the guide connector 3 is to be positioned (see FIG. 2C).

(Slider)

As shown in FIG. 1, the slider 1 includes a substantially box-shaped housing 6 made of an insulative resin. The pressing pins (pressing member) 4 and 5, each extending in the up/down directions, are respectively attached to right and left end portions of the housing 6. Each of the pressing pins 4 and 5 extends below the lower end of the housing 6. The housing 6 has, in its inside, a space configured to accommodate the female connector 2 (see FIG. 2A).

Figure 2A:
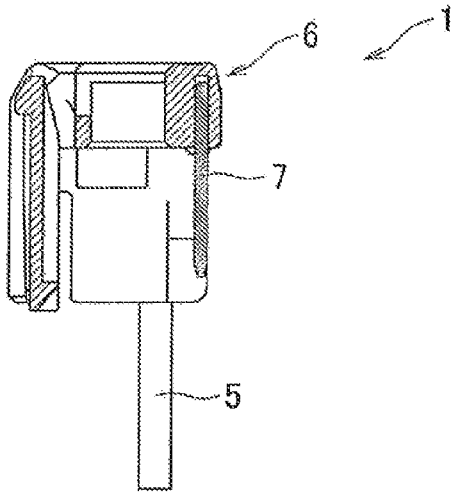
FIG. 2A is a sectional view of a slider taken along the line IIA-IIA of FIG. 1.

As shown in FIG. 2A, long pins 7*a* are mounted in the housing 6. Each of the pins 7 extends in the up/down directions, and configured to be inserted into the female connector 2.

(Female Connector)

Figure 2B:
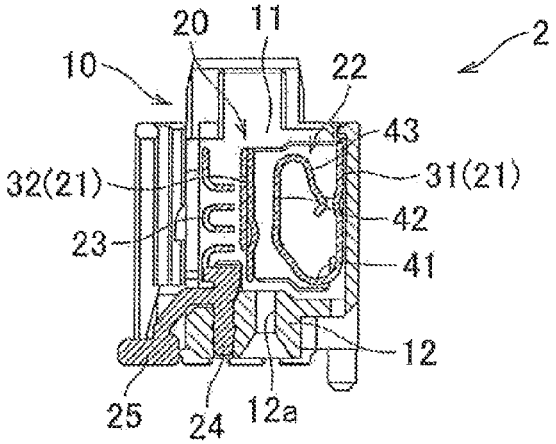
FIG. 2B is a sectional view of a female connector taken along the line IIB-IIB of FIG. 1.

As shown in FIGS. 1 and 2B, the female connector 2 includes: a female housing (a second housing) 10 having a substantially rectangular parallelepiped shape and made of an insulative resin; and five female contacts (a second contact) 20 mounted in the female housing 10.

<Female Housing>

As shown in FIG. 1, the female housing 10 has five accommodation chambers 11 each capable of accommodating a corresponding female contact 20. The five accommodation chambers 11 are aligned in left/right directions.

As shown in FIG. 2B, the female housing 10 has a bottom wall 12, which is perforated in the up/down directions to form through holes 12*a*. The through holes 12*a* are formed below the respective accommodation chambers 11, and communicate with the respective accommodation chambers 11. Each contact 120 having penetrated the substrate 110 is inserted into the corresponding through hole 12*a* from below. After passing through the through hole 12*a*, each contact 120 is inserted into the corresponding accommodation chamber 11.

Each through hole 12*a* includes an upper portion having a constant diameter, and a lower portion having a varying diameter. The lower portion is tapered so that its diameter increases with an increase in the distance from the upper portion. Such a structure facilitates insertion of each contact 120 into the corresponding accommodation chamber 11.

<Female Contact>

As shown in FIGS. 1 and 2B, each female contact 20 includes: a polyangular tubular portion 21 whose upper and lower ends are opened; a bent portion 22 bent to extend around the inner periphery of the polyangular tubular portion 21; an elastic portion 23 configured to be elastically displaced, e.g., in the up/down directions; and a fixed portion 24 and a mounting portion 25 which are located outside the accommodation chamber 11 (see FIG. 2B). The fixed portion 24 extends downward from the lower end of the elastic portion 23. The fixed portion 24 is fixed to the bottom wall 12 of the female housing 10. The mounting portion 25 extends obliquely downward from a midway portion of the fixed portion 24. The mounting portion 25 is to be soldered to the substrate 110.

As shown in FIG. 2B, the polyangular tubular portion 21 includes a front wall portion 31 and back wall portion 32 opposing each other in front/rear directions. Each of the front wall portion 31 and the back wall portion 32 has a protruding portion protruding in a direction toward the opposed wall portion.

The bent portion 22 includes: a lower curved portion 41 extending from the lower end of the front wall portion 31 and curved to form a downward projection; a straight portion 42 extending upward from one end of the lower curved portion 41; and a projecting portion 43 extending from one end of the straight portion 42 while forming a projection toward the front wall portion 31. Between the protruding portion of the front wall portion 31 and the projecting portion 43 is inserted the corresponding pin 7 of the slider 1 (see FIG. 11C). Meanwhile, between the protruding portion of the back wall portion 32 and the straight portion 42 is inserted the corresponding contact 120 (see FIG. 11B).

(Guide Connector)

Figure 2C:
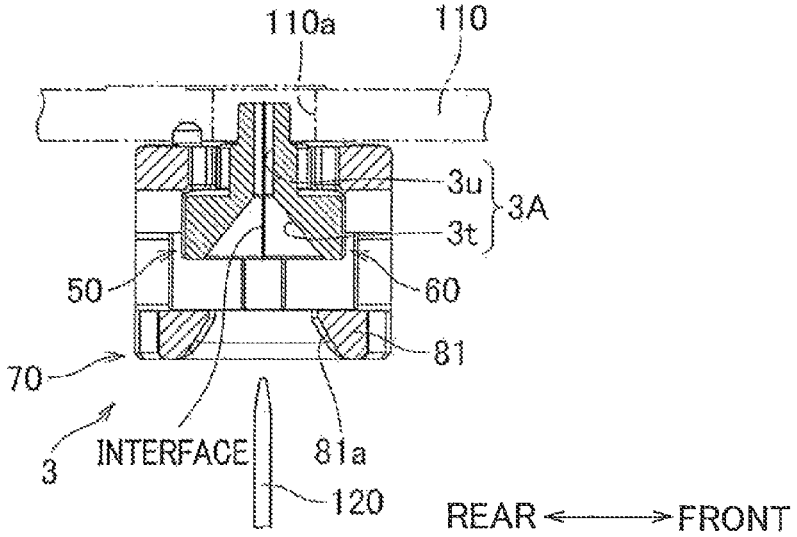
FIG. 2C is a sectional view of a substrate and a guide connector, taken along the line IIC-IIC of FIG. 1.
Figure 3:
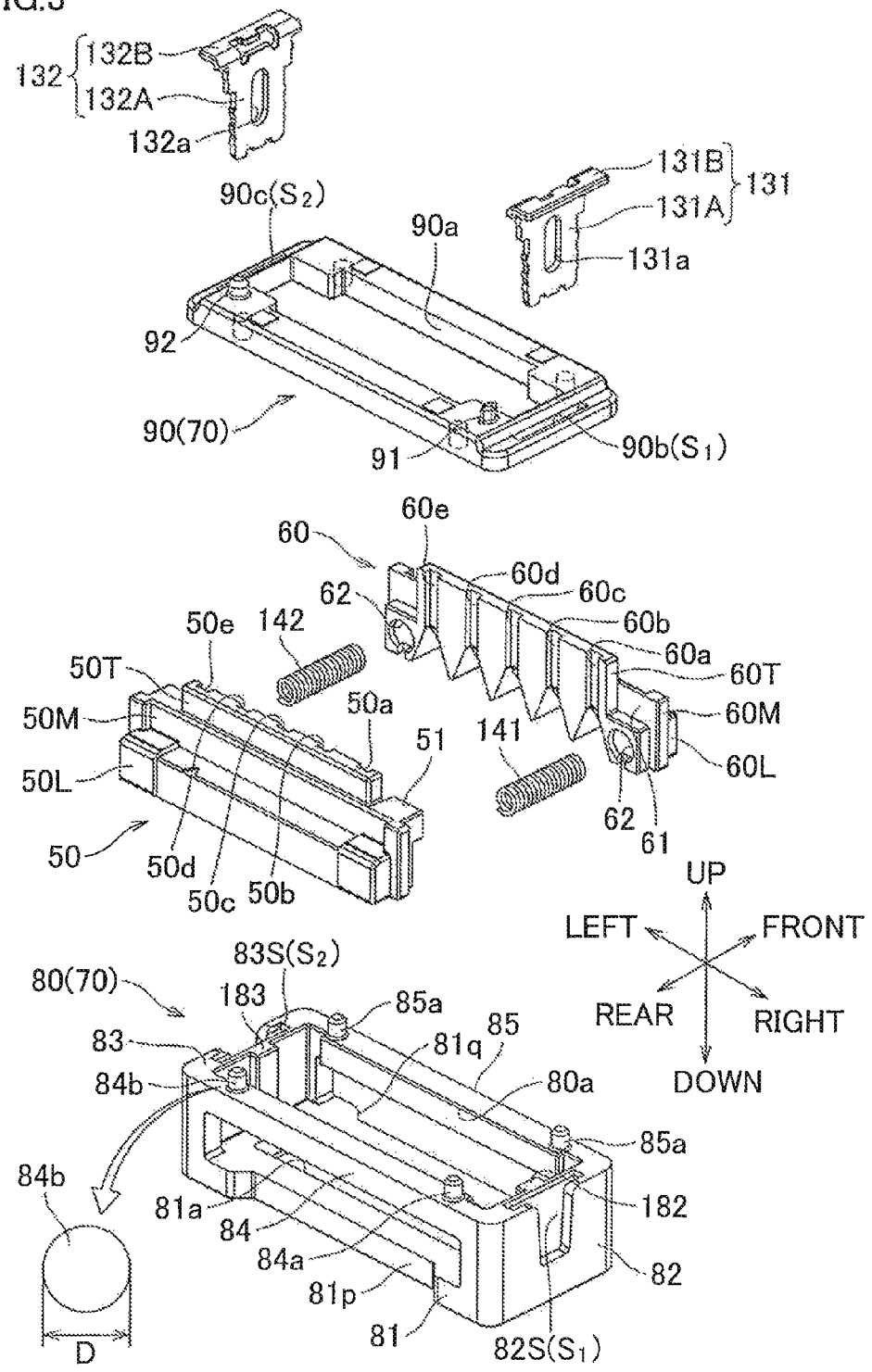
FIG. 3 is as exploded perspective view of the guide connector.

As shown in FIGS. 2C and 3, the guide connector 3 includes a first movable body 50 (rear movable body) and a second movable body 60 (front movable body) opposing each other in the front/rear directions, and a substantially box-shaped housing (a first housing) 70 accommodating these movable bodies. As shown in FIG. 3, the housing 70 includes: a box (a first accommodating member) 80 having an open upper end; and a lid (a second accommodating member) 90 disposed on the box-like body 80 so as to partially close the open upper end. The box-like body 80 and the lid 90 are separable from each other in the up/down directions. Further, the housing 70 has slits $S_1$ and $S_2$ at right and left end portions of the housing 70, respectively. Each of the slits $S_1$ and $S_2$ is formed across the box-like body 80 and the lid 90. Into the slits $S_1$ and $S_2$, strengthening tabs (an insertion member) 131 and 132 are respectively inserted (see FIG. 1). The first movable body 50, the second movable body 60, the housing 70, and the strengthening tabs 131 and 132 are all made of an insulative resin.

As shown in FIG. 3, two springs (a biasing member) 141 and 142 are disposed between the first movable body 50 and the second movable body 60. One of the springs (biasing member) 141 is disposed between respective right end portions of the two movable bodies 50 and 60, while the other spring (biasing member) 142 is disposed, between respective left end portions of the two movable bodies 50 and 60.

Each of the springs 141 and 142 is elastically deformable in the front/rear directions, and biases the first movable body 50 and the second movable body 60 in directions away from each other. The first movable body 50 and the second movable body 60 are thus biased so as to move in the directions away from each other. In the housing 70, the movable bodies are configured to make a transition from a close state (see FIGS. 5A, 6A, 11A, and 11B), in which the movement of the movable bodies in the directions away from each other is restricted, by the housing 70, to a separated state (see FIGS. 5B, 6B, and 11C), in which the movable bodies are more distant from each other than in the close state. In the close state, the respective surfaces of the first movable body 50 and the second movable body 60 which surfaces oppose each other (hereinafter the "opposing surfaces") are in contact with each other (see FIGS. 5A, 11A, and 11B). In the separated state, as the springs 141 and 142 further extend in the front/rear directions than in the close state, the first movable body 50 and the second movable body 60 are more distant from each other (see FIGS. 5B and 11C). Note that in FIGS. 5B and 6B, the pressing pins 4 and 5 are not illustrated.

[First Movable Body, Second Movable Body]

Figure 4A:
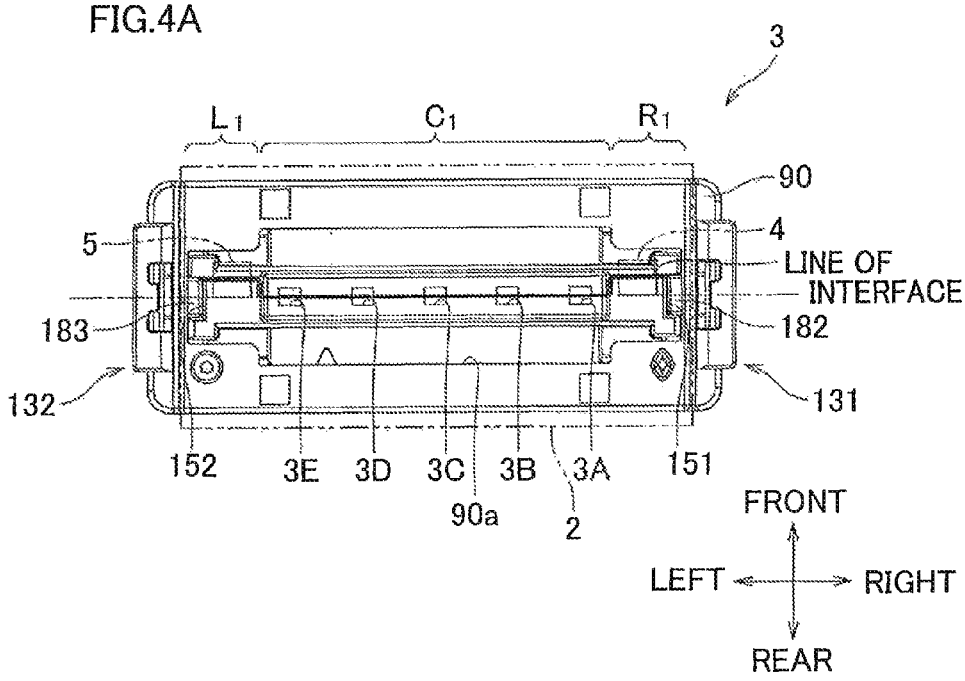
FIG. 4A is a plan view of the guide connector.

As shown in FIG. 3, each of the first movable body 50 and the second movable body 60 has a side portion of a stairway-like shape on the opposite side of the body from the surface opposing the counterpart. The stairway-like side portion has three stages (an upper stage 50T, a middle stage 50M, and a lower stage 50L of the first movable body 50; and an upper stage 60T, a middle stage 60M, and a lower stage 60L of the second movable body 60). The first movable body 50 and the second movable body 60 have substantially the same structure except that of the right and left end portions. In this embodiment, as shown in FIG. 4A, the section constituted by the right end portions of the two movable bodies 50 and 60 is referred to as a right end section $R_1$, the section constituted by the left end portions of the movable bodies 50 and 60 is referred to as a left end section $L_1$, and the section between the right end section $R_1$ and the left end section $C_1$ is referred to as a central section $C_1$. The central section $C_1$ is shaped to have three stages which are the upper stage, the middle stage, and the lower stage. Each of the right end section $R_1$ and the left end section $L_1$ is shaped to have two stages which are the middle stage and the lower stage (see FIG. 3). Above the right end section $R_1$ and the left end section $L_1$, the pressing pins 4 and 5 are supposed to be positioned, respectively.

<Central Section $C_1$>

As shown in FIG. 3, the first movable body 50 has, on its surface opposing the second movable body 60, five recesses 50*a*, 50*b*, 50*c*, 50*d*, and 50*e* aligned in the left/right directions. The second movable body 60 has, on its surface opposing the first movable body 50, five recesses 60*a*, 60*b*, 60*c*, 60*d*, and 60*e* aligned in the left/right directions. These recesses are formed so that the recesses of the first movable body 50 respectively oppose the recesses of the second movable body 60 with respect to the front/rear directions. In the close state, each recess of the first movable body and a corresponding recess of the second movable body, which recesses oppose each other in the front/rear directions (e.g., the recess 50*a* of the first movable body 50 and the recess 60*a* of the second movable body 60) form one contact insertion hole (e.g., a contact insertion hole 3A) (see FIGS. 1, 4A, and 4B). Thus, the opposing surfaces of the first movable body 50 and the second movable body 60 define five contact insertion holes 3A, 3B, 3C, 3D, and 3E (see FIG. 1).

Into the contact insertion holes 3A, 3B, 3C, 3D, and 3E, contacts 120 each extending in the up/down directions are respectively inserted from below (see FIGS. 1 and 2C). While the contacts 120 are inserted, the first movable body 50 and the second movable body 60 are opposed to each other with the contacts 120 interposed therebetween (see FIG. 6B).

As shown In FIG. 2C, the contact insertion hole 3A includes an upper section 3*u* whose diameter is constant, and a tapered section 3*t* whose diameter varies to form a tapered shape. The tapered section 3*t* is located below the upper section 3*u*. The tapered section 3*t* is tapered down toward the upper section 3*u*. The upper section 3*u* and the upper end of the tapered section 3*t* have the smallest diameter of the contact insertion hole 3A. The smallest diameter is not smaller than the diameter of each contact 120. Note that each of the contact insertion holes 3B to 3E has the same structure as that of the contact insertion hole 3A.

As shown in FIG. 2C, in the central section $C_1$, the interface between the first movable body 50 and the second movable body 60 is located substantially at the center with respect to the front/rear directions across its length from the upper end to the lower end (see FIG. 4A). Note that the "front/rear directions" are the directions in which the first movable body 50 and the second movable body 60 are moved relative to each other by the springs 141 and 142.

<Right End Section $R_1$, Left End Section $L_1$>

In the right end section $R_1$, the middle stage 50M of the first, movable body 50 is provided with a projection 51 projecting toward the second movable body 60, as shown in FIG. 3. On the other hand, the middle stage 60M of the second movable body 60 has a dent 61 capable of receiving the projection 51. Because of this configuration, in the close state, the interface between the middle stage 50M of the first movable body 50 and the middle stage 60M of the second movable body 60 is offset toward the front from the center with respect to the front/rear directions, as shown in FIG. 5A. On the other hand, the interface between the lower stage 50L of the first movable body 50 and the lower stage 60L of the second movable body 60 is located substantially at the center with respect to the front/rear directions. Further, the projection 51 of the first movable body 50 overlaps the lower stage 60L of the second movable body 60 when viewed from the up/down directions.

The lower stages 50L and 60L accommodate the spring 141. In the lower stages 50L and 60L, the spring 141 intersects the interface between the two movable bodies 50 and 60. A part of the spring 141 is located in a hole 52 of the first movable body 50, and another part of the spring 141 is located in a hole 62 of the second movable body 60. The holes 52 and 62 oppose each other in the front/rear directions, and have substantially the same size. Therefore, in the close state, the rear half of the spring 141 is located in the hole 52, and the front half of the spring 141 is located in the hole 62. Thus, the spring 141 is held by the first movable body 50 and the second movable body 60 substantially equally. When the first movable body 50 and the second movable body 60 are released, the spring 141 extends toward the front and the back equally, as shown in FIG. 5B.

As shown in FIG. 4A, in the close state, a recess 151 opening to the right end of the housing 70 is formed in the right end section $R_1$. As shown in FIG. 6A, the recess 151 extends from the upper ends to the lower ends of the first movable body 50 and the second movable body 60.

In the recess 151, a restriction rib 182 of the housing 70 is positioned. The restriction rib 182 is sandwiched by the first movable body 50 and the second movable body 60 in the front/rear directions. A surface 54 of the first movable body 50 which surface opposes the restriction rib 182 in the front/rear directions and a surface 64 of the second movable body 60 which surface opposes the restriction rib 182 in the front/rear directions extend in the up/down directions.

Figure 4B:
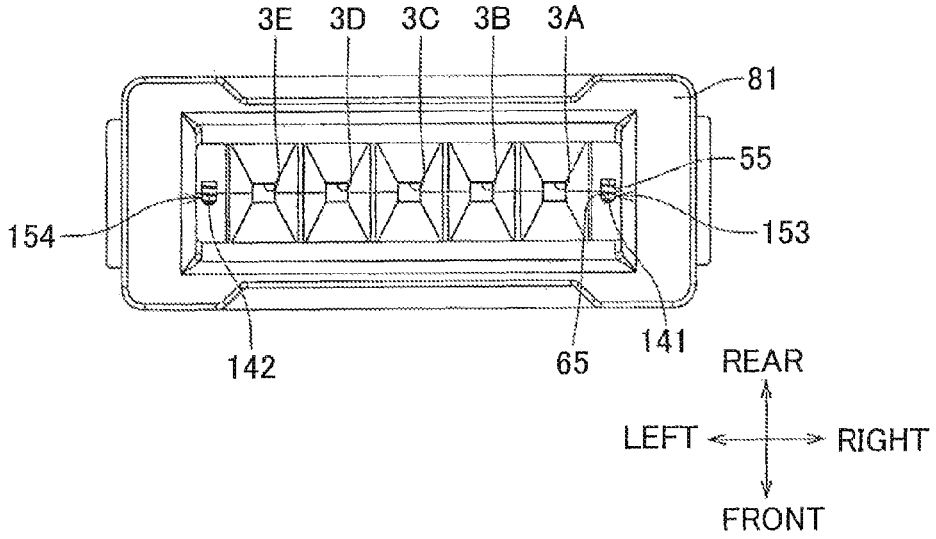
FIG. 4B is a bottom view of the guide connector.

As shown in FIG. 4B, at the bottom of the first movable body 50 and the bottom of the second movable body 60, there are respectively formed recesses 55 and 65 opposing each other in the front/rear directions. The recesses 55 and 65 are respectively in communication with the holes 52 and 62 in which the spring 141 is disposed. In the close state, the two recesses 55 and 65 are combined, to form a window 153 through which the spring 141 in the holes 52 and 62 is visible. This makes it possible to check the presence/absence of the spring 141 when looking at the bottom of the guide connector 3. In a plan view, the recess 55 has a quadrangular shape, while the recess 65 has a semi oval shape. The different, shapes of the recess 55 and the recess 65 show which is the first movable body 50 or the second movable body 60 between the two bodies.

The left end section $L_1$ has substantially the same structure as that of the right end section $R_1$. Also in the left end section $L_1$, in the close state, the interface between the respective middle stages of the first movable body 50 and the second movable body 60 is offset toward the front from the center with respect to the front/rear directions, while the interface between the respective lower stages of the first movable body 50 and the second movable body 60 is located substantially at the center with respect to the front/rear directions, as shown in FIG. 5A. The two movable bodies 50 and 60 partially overlap each other when viewed from the up/down directions. In this embodiment, the pressing pin 5 is fixed so as to be located above the overlapping portion (see FIG. 4A). Further, as shown in FIG. 4A, a recess 152 opening to the left end of the housing 70 is formed in the left end section $L_1$. In the recess 152, the restriction rib 183 is positioned. A surface of the first movable body 50 which surface opposes the restriction rib 183 in the front/rear directions and a surface of the second movable body 60 which surface opposes the restriction rib 183 in the front/rear directions extend in the up/down directions. Further, at the bottom of the left end section $L_1$, there is formed a window 154 through which the spring 142 is visible, as shown in FIG. 4B.

Referring back to FIG. 4A, in the close state, the line of the interface between first movable body 50 and the second movable body 60 which line is on the top surface of the guide connector 3 is located substantially at the center with respect to the front/rear directions in the central section $C_1$, while the line of the interface is offset toward the front from the center with respect to the front/rear directions in the right end section $R_1$ and the left, end section $L_1$.

[Housing]

<Box-Like Body>

As shown in FIG. 3, the box-like body 80 of the housing 70 includes: a bottom wall 81; a right wall 82; a left wall 83; and two restriction beams 84 and 85 each extending from, the upper end of the right wall 82 to the upper end of the left wall 83. There is a space between the bottom wall 81 and each of the restriction beams 84 and 85. The box-like body 80 has an upper end portion having an opening 80*a* defined by the right wall 82, the left wall 83, and the restriction beams 84 and 85. The opening 80*a* is sized so that the lower stages 50L and 60L of the two movable bodies 50 and 60 in the close, state can be disposed, at the same time in the opening 80*a* from above (see FIG. 9A).

The bottom wall 81 has recesses 81*p* and 81*q* respectively formed at side portions of the bottom wall 81. The recesses 81*p* and 81*q* make it easier to pinch the bottom wall 81 with respect to the front/rear directions. This facilitates the movement of the guide connector 3 to the position below the substrate 110. Further, the bottom wall 81 has an opening 81*a*. As shown in FIG. 2C, the size of the opening 81*a* decreases toward the upper end of the opening 81*a*.

Referring back to FIG. 3, the right wall 82 and the left wall 83 respectively have slits 82S and 83S, each extending in the up/down directions. Into the slits 82S and 83S, the strengthening tabs 131 and 132 are respectively inserted, At a middle portion of the right wall 82 with respect to the front/rear directions, there is provided a restriction rib 182 protruding toward the left wall 83. Likewise, at a middle portion of the left wall 83 with respect to the front/rear directions, there is provided a restriction rib 183 protruding toward the right wall 82.

Each of the restriction ribs 182 and 183 extends in the up/down directions from the upper end to the lower end of corresponding one of the right wall 82 and the left wall 83 (see FIGS. 6A and 6B). During the transition from the close state to the separated state, the restriction ribs 182 and 183 are always interposed between the first movable body 50 and the second movable body 60, and the restriction ribs 182 and 183 are configured to be slidable on the surfaces 54 and 64 of the two movable bodies 50 and 60. In the close state, the restriction ribs 182 and 183 are in contact with the first, movable body 50 and the second movable body 60, and there is hardly any gap between the ribs and the bodies (see FIG. 6A).

The restriction beams 84 and 83 of the box-like body 80 shown in FIG. 3 restrict the movement of the two movable bodies 50 and 60 in the directions away from each other (see FIGS. 5A and 5B). In the close state, as shown in FIG. 5A, the lower stage 50L of the first movable body 50 and the lower stage 60L of the second movable body 60 are respectively in contact with the restriction beams 84 and 85. Meanwhile, in the separated state, as shown in FIG. 5B, the middle stage 50M of the first movable body 50 and the middle stage 60M of the second movable body 60 are respectively in contact with the restriction beams 84 and 85.

As shown in FIG. 3, the restriction beam 84 is provided with, on its top surface (the surface opposing the lid 90), bosses (a protrusion) 84*a* and 84*b* respectively formed at its right and left end portions. The restriction be is also provided with, on its top surface (the surface opposing the lid 90), bosses (the protrusion) 85*a* and 85*b* respectively formed at its right and left end portions. The bosses 84*a*, 84*b*, 85*a*, and 85*b* are fitted into four holes formed on an under surface of the lid 90 (see holes 92*a* to 92*d* in FIG. 7). As shown in an enlarged view of the boss 84*b* included in FIG. 3, each of the bosses 84*a*, 84*b*, 85*a*, and 85*b* is formed into a substantially cylindrical shape having a diameter D.

<Lid>

As shown in FIG. 3, the lid 90 has an opening 90*a*. The opening 90*a* is smaller than the opening 80*a* of the box-like body 80. The opening 90*a* is sized so that the upper stages and the middle stages of the first movable body 50 and the second movable body 60 are visible through the opening 90*a* while the movable bodies are in the close state (see FIG. 4A). At the right and left of the opening 90*a*, there are respectively formed tab receiving holes 90*b* and 90*c* into which the strengthening tabs 131 and 132 are respectively inserted.

The tab receiving hole 90*b* and the slit 82S of the box-like body 80 form the slit $S_1$ of the housing 70 (see FIG. 1). The tab receiving hole 90*c* and the slit 83S of the box-like body 80 form the slit $S_2$ of the housing 70.

Referring back to FIG. 3, the lid 90 is provided with bosses 91 and 92 on its top surface. The bosses 91 and 92 are configured to be fitted into holes (not shown) formed on a lower surface of the substrate 110 (see FIGS. 5A and 5B). The shapes of the two bosses 91 and 92 are different from each other, and the shapes of the holes into which the bosses 91 and 92 are respectively fitted are also different from each other. Therefore, if the guide connector 3 is positioned the wrong way around (for example, in the opposite way with respect to the left/right directions), the bosses 91 and 92 are not fitted in the holes of the substrate 110. This structure prevents the guide connector 3 from being positioned the wrong way around.

Figure 7:
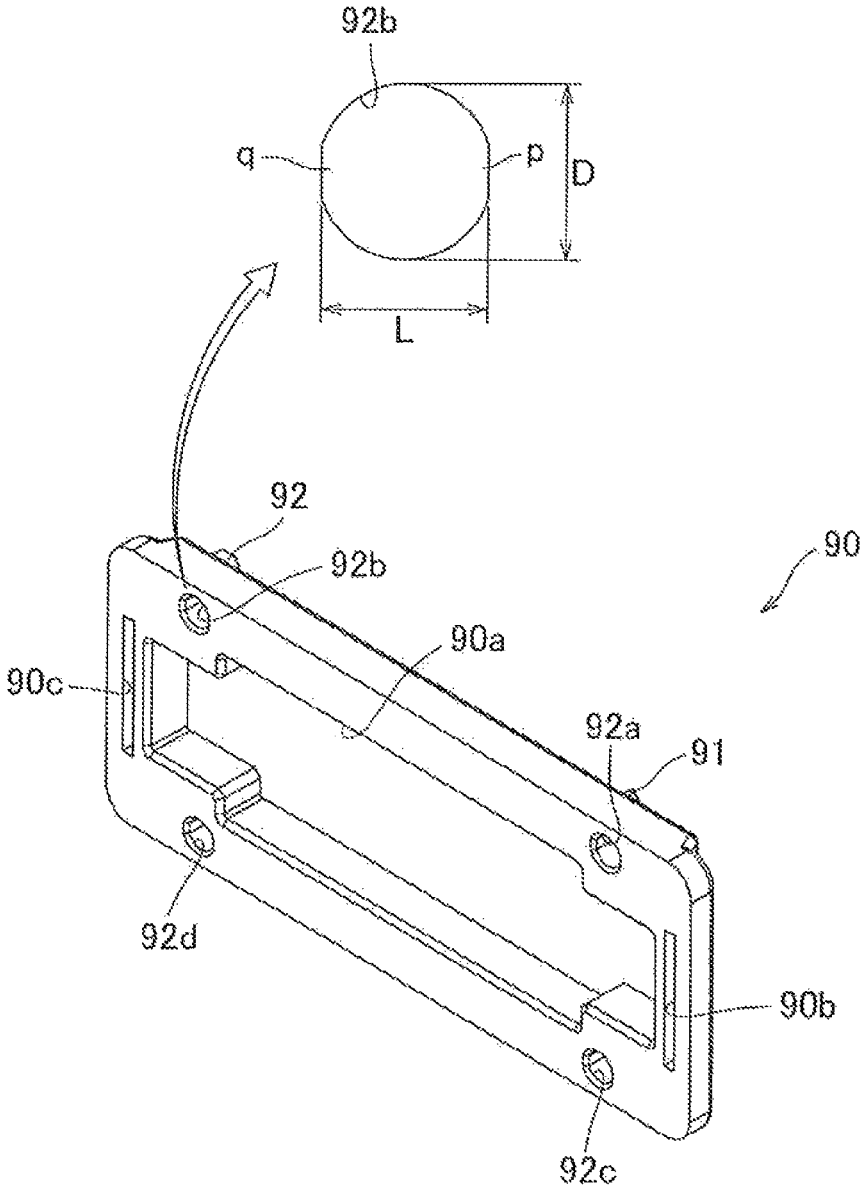
FIG. 7 is a perspective view of a lid of the guide connector, illustrating a bottom surface of the lid.

As shown in FIG. 1, the holes (a recess) 92*a*, 92*b*, 92*c*, and 92*d* are respectively formed in the vicinity of the four corners on the under surface of the lid 90. As shown in FIG. 3, the holes 92*a*, 92*b*, 92*c*, and 92*d* are positioned so as to correspond to the bosses 84*a*, 84*b*, 85*a*, and 85*b*. As shown in an enlarged view included in FIG. 7, each of the holes 92*a*, 92*b*, 92*c*, and 92*d* has a near-circular shape of which circular portion has the diameter D. The hole 92*b* has two smaller diameter portions p and q which oppose each other in the left/right directions (i.e., in a racial direction). Each of the smaller diameter portions p and q is a plane perpendicular to a bottom surface of the hole 92*b*, and opposes a part of a circumferential surface (side circumferential surface) which is a side surface of the hole 92*b* (that is, each plane opposes the counterpart one of the smaller diameter portions p and q). The distance between the smaller diameter portions p and q is shorter than too diameter D. Further, the depth of the hole 92*b* is slightly longer than the height of the boss 85*b*. Although the enlarged view in FIG. 7 is for the hold 92*b* only, each of the holes 92*a*, 92*c*, and 92*d* has the same structure as the hole 92*b*.

<Strengthening Tab>

As slows in FIG. 3, each of the strengthening tabs 131 and 132 is a substantially quadrangular plate-like member, and includes a plate portion 131A, 132A extending in the up/down directions, and a horizontal portion 131B, 132B extending from the upper end of the plate portion 131A, 132A in a direction away from the housing 70. The plate portions 131A and 132A respectively have, at respective central portions, through holes 131*a* and 132*a* each of which has a long hole shape. The horizontal portions 131B and 132B are to be soldered to the lower surface of the substrate 110, to enhance the strength of the connection between the guide connector 3 and the substrate 110.

Figure 8:
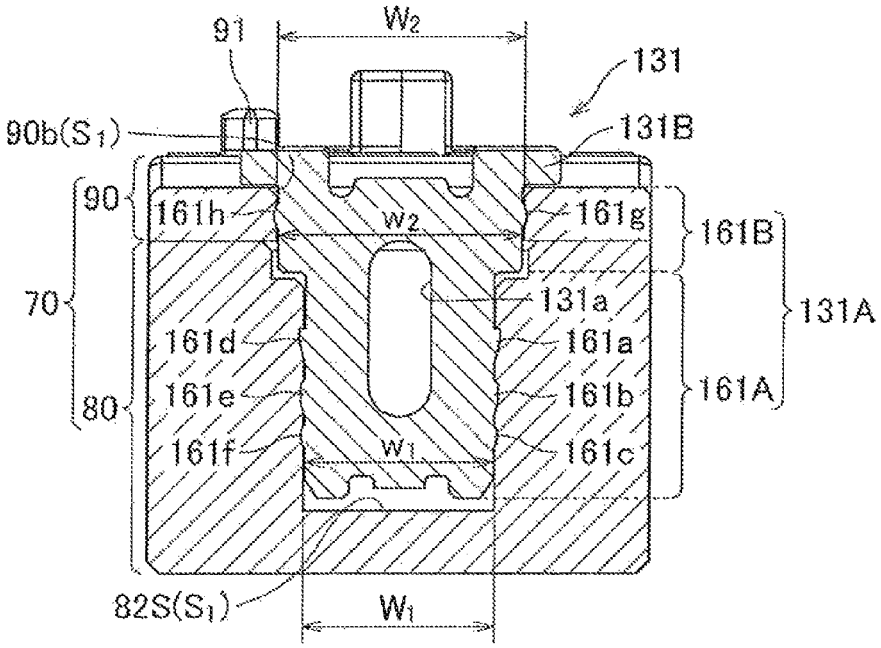
FIG. 8 is a sectional view of the guide connector.

As shown in FIG. 8, the plate portion 131A of the strengthening tab 131 includes: a first opposing portion 161A opposing the box-like body 80; and a second opposing portion 161B opposing the lid 90.

The first opposing portion 161A has, on its right side portion, jags (a first pressing portion) 161*a*, 151*b*, and 161*c* each projecting to the right in FIG. 8. The first opposing portion 161A further has, on its left side portion, jags (the first pressing portion) 161*d*, 161*e*, and 161*f* each projecting to the left in FIG. 8. Basically the width (the width in the left/right directions in FIG. 8) $w_1$ of the first opposing portion 161A is substantially the same as the width $W_1$ of the slit 82S of the box-like body 80; however, each portion of the first opposing portion 161A, which portion has any of the jags 161*a*, 161*b*, 161*c*, 161*d*, 161*e*, and 161*f*, has a width longer than the width $W_1$ of the slit 82S.

Further, the second opposing portion 161B has, on its right side portion, a jag (a second pressing portion) 161*g* projecting to the right. The second opposing portion 161B further has, on its left side portion, a jag (the second pressing portion) 161*h* projecting to the left. Basically, the width (the width in the left/right directions in FIG. 8) $w_2$ of the second opposing portion 161B is substantially the same as the width $W_2$ of the tab receiving hole 90*b* of the lid 90; however, a portion of the second opposing portion 161B, which portion has the jags 161*g* and 161*h*, has a width longer than the width $W_2$ of the tab receiving hole 90*b*.

Due to the above structure, when the strengthening tab 131 is inserted into the slit $S_1$, the jags 161*a*, 161*b*, and 161*c* of the first opposing portion 161A press the box-like body 80 to the right, and the jags 161*d*, 161*e*, and 161*f* press the box-like body 80 to the left. Further, the jag 161*g* of the second opposing portion 161B presses the lid 90 to the right, and the jag 161*h* presses the lid 90 to the left. Since the strengthening tab 131 is secured to the box-like body 80 and the lid 90 after the lid 90 and the box-like body 80 are combined together, the lid 90 and the box-like body 80 are firmly combined with each other.

Furthermore, the horizontal portion 131B of the strengthening tab 131 is positioned close to the lid 90 while opposing the lid 90. The lid 90 is sandwiched by the horizontal portion 131B and the box-like body 80, and this makes it difficult for the lid 90 to detach from the box-like body 80.

Note that the strengthening tab 132 has the same structure as that of the strengthening tab 131.

Now, a process of assembling the guide connector 3 will be described, with reference to FIGS. 9A to 9D.

Figures 9A, 9B, 9C, 9D:
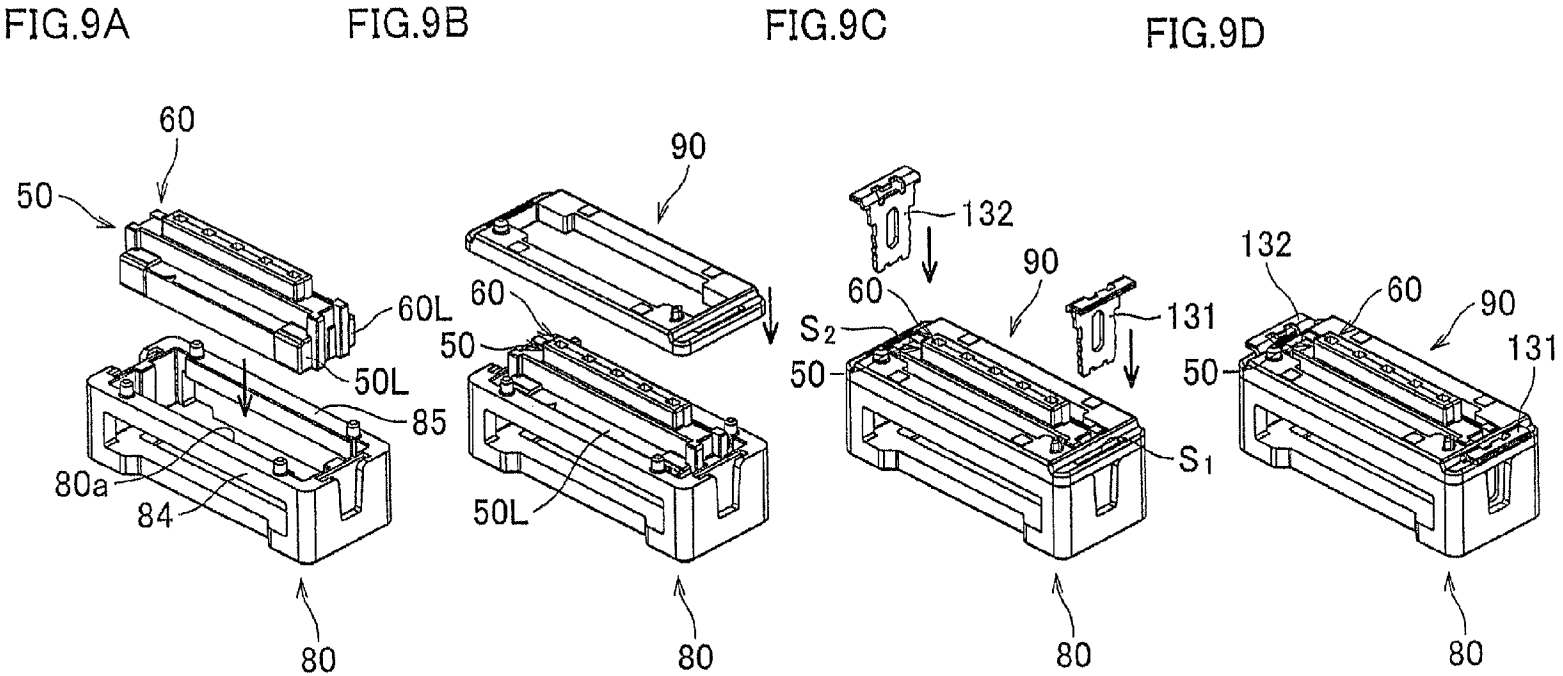
FIGS. 9A to 9D are perspective views of the guide connector, showing a sequence of assembling the guide connector.

As shown in FIG. 9A, the first movable body 50 and the second movable body 60 are first brought close to each other while sandwiching the springs 141 and 142 (not shown). The two movable bodies 50 and 60 held in the above state are put in the box-like body 80 through the opening 80*a* at the upper end portion of the box-like body 80. At this time, an outer side surface of the lower stage 50L of the first movable body 50 and an outer side surface of the lower stage 60L of the second movable body 60 (each outer side surface is a surface extending in the left/right directions) are brought into contact with the restriction beams 84 and 85 of the box-like body 80, respectively, and thereby the two movable bodies 50 and 60 are held in the close state (see FIG. 9B).

Then, the lid 90 is attached to the upper end of the box-like body 80 (see FIGS. 9B and 9C). Thereafter, the strengthening tabs 131 and 132 are respectively inserted into the slits $S_1$ and $S_2$ of the housing 70 (see FIGS. 9C and 9D).

Figure 10A:
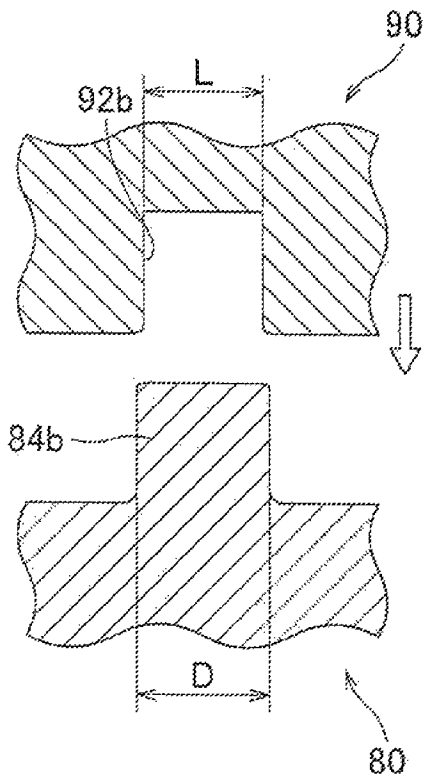
FIGS. 10A to 10C are sectional views showing a process of combining the lid with a box-like body.
Figure 10B:
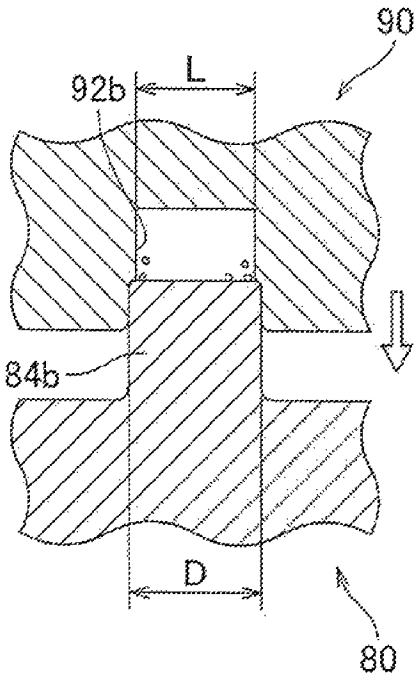
Figure 10C:
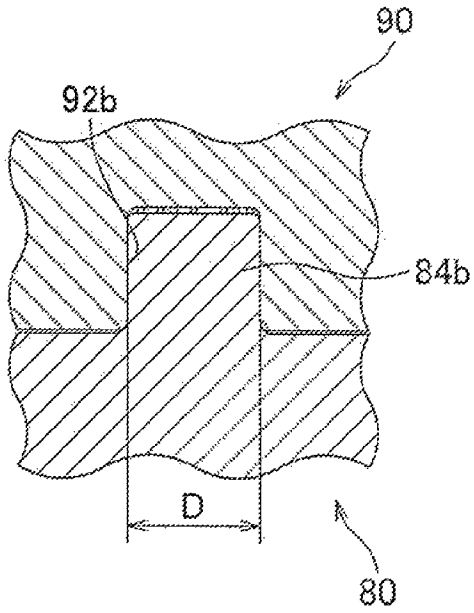

Now, description will be given for a fit, for example, between the boss 84*b* of the box-like body 80 and the hole 92*b* of the lid 90, with reference to FIGS. 10A to 10C.

When the lid 90 is lowered (see FIG. 10A), the boss 84*b* (having the diameter D) is brought into contact with inner wall portions of the smaller diameter portions p and q of the hole 92*b*. Thus, the inner wall portions are scraped away, to generate shavings (see FIG. 10B), and the shavings remain in the hole 92*b*. When the lid 90 is completely levered, the shavings are held at the bottom of the hole 92*b*. Further, the smaller diameter portions p and q are removed, and this causes the hole 92*b* to have a substantially circular shape of the diameter D.

Next, description will be given for a process of transition of the first movable body 50 and the second movable body 60 from the close state to the separated state, with reference to FIGS. 11A to 11C. FIGS. 11A to 11C are sectional views, each taken along a line IIA-IIA, a line IIB-IIB, and a line IIC-IIC of FIG. 1. It should be noted that, in each of FIGS. 11A to 11C, there are illustrated: the pressing pin 5 out of the pressing pins 4 and 5; the contact insertion hole 3A out of the contact insertion holes 3A to 3E; a contact 120 out of the contacts 120; and the spring 142 out of the springs 141 and 142.

First, as shown in FIG. 11A, the female connector 2 is soldered onto an upper surface of the substrate 110. At this time, the slider 1 is disposed so as to cover the top of the female connector 2, and each of the pins 7 is not inserted between the protruding portion of the front wall portion 31 and the projecting portion 43 of the corresponding female contact 20 (semi-fit state). Further, the guide connector 3 is secured to the lower surface of the substrate 110, and the first movable body 50 and the second movable body 60 are in the close state.

In the close state, the outer side surface of the lower stage 50L of the first movable body 50 and the outer side surface of the lower stage 60L of the second movable body 60 are respectively in contact with the restriction beams 84 and 85 of the guide connector 3. The female connector 2 is on the substrate 110. Each of the pressing pins 4 and 5 is located above the middle stage 50M of the first movable body 50 and the middle stage 60M of the second movable body 60, at a position offset toward the front from the center of the guide connector 3 with respect to the front/rear directions (see FIG. 5A).

Then, the contacts 120 are inserted into the guide connector 3 from below (see FIG. 11B). Each contact 120 passes through the corresponding contact insertion hole (3A to 3E) of the guide connector 3, and penetrates the substrate 110. Then, each contact 120 is inserted between the protruding portion of the back wall portion 32 and the straight portion 42 of the corresponding female contact 20. This causes the contact 120 to contact at least one of the back wall portion 32 and the straight portion 42, and thereby electric connection, between them is established.

In this state, the slider 1 is pressed down (full-fit state). This moves the pressing pins 4 and 5 downward, to press the middle stage 50M of the first movable body 50 and the middle stage 60M of the second movable body 50 (see FIG. 5A). With this, the two movable bodies 50 and 60 are pressed down, and moved away from the female connector 2. The lower stage 50L of the first movable body 50 and the lower stage 50L of the second movable body 60 are also moved downward, with the result that the cuter side surfaces of the lower stages 50L and 60L detach from the restriction beams 84 and 85 (see FIG. 5B). Thus, the first movable body 50 and the second movable body 60 are released. As a result, the springs 141 and 142 extend, which moves the first movable body 50 and the second movable body 60 in directions away from each other, to move the first and second movable bodies 50 and 60 away from the contacts 120 (see FIG. 11C). Then, the middle stage 50M of the first movable body 50 and the middle stage 60M of the second movable body 60 are respectively brought into contact with the restriction beams 84 and 85, and the upper stage 50T of the first movable body 50 and the upper stage 60T of the second movable body 60 are brought into contact with the lid 90 (see FIG. 11C). This restricts further movement of the first movable body 50 and the second movable body 60.

Further, when the slider 1 is pressed down, each pin 7 is moved, to be positioned between the protruding portion of the front wall portion 31 and the projecting portion 43 of the corresponding female contact 20, as shown in FIG. 11C. This displaces the projecting portion 43 toward the corresponding contact 120, thereby improving the accessibility between the female contact 20 and the contact 120.

As described above, the connector 100 of this embodiment provides the following advantageous effects. The first movable body 50 and the second movable body 60 are pressed using the pressing pins 4 and 5 after the electrical connection between the contacts 120 and the respective female contacts 20 are established, and thereby the two movable bodies 50 and 60 are moved away from the contacts 120. Thus, even if the housing 70, the first movable body 50, and the second movable body 60 are vibrated, or even if the substrate 110 is vibrated in addition to these members to cause resonance, the contacts 120 are not influenced by such vibration and/or resonance. Accordingly, wear of and damage to the contacts 120 are prevented.

Further, the guide connector 3 is easily assembled merely by combining the lid 90, from above, with the box-like body 80 in which the first movable body 50 and the second movable body 60 are arranged in the close state.

Furthermore, when the lid 90 is combined with the box-like body 80, the bosses 84*a*, 84*b*, 85*a*, and 85*b* formed on the box-like body 80, and the holes 92*a*, 92*b*, 92*c*, and 92*d* formed on the lid 90 facilitate alignment between the lid 90*a* and the box-like body 80.

Moreover, since the smaller diameter portions p and q are provided, in each of the holes 92*a*, 92*b*, 92*c*, and 92*d*, each hole has a portion whose diameter is shorter than the diameter D of each of the bosses 84*a*, 84*b*, 85*a*, and 85*b*. Therefore, as each boss is inserted into the corresponding hole, the inner wall portion defining the hole is scraped away, and the boss closely contacts the hole. Thus, each boss is tightly fitted into the corresponding hole, and therefore the lid 90 is firmly secured to the box-like body 80. When the bosses 84*a*, 84*b*, 85*a*, and 85*b* are fitted into the respective holes 92*a*, 92*b*, 92*c*, and 92*d*, the inner wall portion defining each hole is scraped away to generate shavings. These shavings are held at the bottom of each of the holes 92*a*, 92*b*, 92*c*, and 92*d*. As a result, the lid 90 is fitted to the box-like body 80 without a gap therebetween, thereby preventing entry of foreign matter into the housing 70, and the lid 90 is more firmly secured to the box-like body 80. Furthermore, each of the smaller diameter portions p and q is formed into a plane, and this makes it easier to form the smaller diameter portions in each hole.

Moreover, when the strengthening tabs 131 and 132 are respectively inserted into the slit $S_1$ and $S_2$ of the housing 70, the jags 161*a*, 161*b*, and 161*c* of the first opposing portion 161A press the box-like body 80 to the right, and the jags 161*d*, 161*e*, and 161*f* of the first opposing portion 161A press the box-like body 80 to the left. With this, the strengthening tabs 131 and 132 are firmly secured to the box-like body 80. Meanwhile, the jag 161*g* of the second opposing portion 161B presses the lid 90 to the right, and the jag 161*h* of the second opposing portion 161B presses the lid 90 to the left. With this, the strengthening tabs 131 and 132 are firmly secured to the lid 90.

Further, the horizontal portions 131B and 132B of the strengthening tabs 131 and 132 are positioned close to the lid 90 while opposing the lid 90. This prevents the lid 90 from being detached from the box-like body 80, and therefore the lid 90 is more firmly secured to the box-like body 80.

Thus, the embodiment of the present invention has been described hereinabove with reference to attached drawings. It should be however noted that specific structure of the present invention is not limited to the embodiment. The scope of the present invention is defined by claims, not by the above description, and shall encompass all changes that fall within the equivalent meaning and scope of the claims.

For example, the structure of the slider 1, the structure of the female connector 2, and the structure of the pressing pins 4 and 5 (such as the positions where the pins are attached, and the shape of the pins) are respectively not limited to those described in the above-described embodiment, and may be altered. The pressing pins 4 and 5 do not have to be attached to the slider 1. For example, the pressing member may be a member constituted by a long rod, and may be attached to a member other than the slider. Further, the slider 1 does not have to be included.

In the above-described embodiment, the transition of the first movable body 50 and the second movable body 60 from, the close state to the separated state is made (see FIG. 11C) after the electrical connection between each contact 120 and the corresponding female contact 20 is established. However, the timing of transition to the separated state is not limited to this. For example, the transition to the separated state may be made simultaneously with the establishment of the electrical connection between each contact 120 and the corresponding female contact 20, as long as each contact 120 has been inserted into the corresponding contact insertion hole (e.g., the contact insertion hole 3A) of the guide connector 3. Alternatively, the transition of the two movable bodies 50 and 60 to the separated state may be made after the insertion of each contact 120 into the corresponding contact insertion hole and before the contact 120 is electrically connected with the corresponding female contact 20.

Further, in the above-described embodiment, the first movable body 50 and the second movable body 60 which are in the close state are arranged in the box-like body 80, and then the lid 90 is attached to the box-like body 80 from above; however, the structure of the guide connector 3 is not limited to this, and may be altered. For example, the following structure is possible: the first movable body 50 and the second movable body 60 which are in the separated state are arranged in the box-like body 80, and a transition to the close state, is made when the lid 90 is attached to the box-like body 80 from above. In this case, the first movable body 50 and the second movable body 60 may be in contact with the lid 90 in the close state without contacting the box-like body 80.

In addition, in the above-described embodiment, the first movable body 50 and the second movable body 60 are in contact with the box-like body 80 in the close state without contacting the lid 90; however, the first movable body and the second movable body 60 may be in contact with the box-like body 80 and the lid 90 in the closed state.

Further, in the above-described embodiment, the housing 70 includes the box-like body 80 and the lid 90 which are separable from each other in the up/down directions; however, the two members does not have to be separable from each other in the up/down directions. The housing 70 may be constituted by members separable from each another in the left/right directions. For example, the following structure is possible: a right wall portion of the housing 70 is separable, and the two movable bodies 50 and 60 are inserted into the housing 70 through a right opening formed when the right wall portion is separated.

Furthermore, in the above-described embodiment, the box-like body 80 is provided with the bosses 84*a*, 84*b*, 85*a*, and 85*b*, and the lid 90 has the holes 92*a*, 92*b*, 92*c*, and 92*d*. However, another structure is also possible in which the box-like body 80 has the holes and the lid 90 is provided with the bosses. Each of the box-like body 80 and the lid 90 does not have to include the bosses or the holes.

Additionally, in the above-described embodiment, each of the holes 92*a*, 92*b*, 92*c*, and 92*d* has the smaller diameter portions p and q each causing the hole to partially have the diameter L shorter than the diameter D of the corresponding boss. However, such a smaller diameter portion does not have to be provided. The number of the smaller diameter portions for each hole may be one, or two or more. Further, each of the smaller diameter portions p and q does not have to be a plane, and may be a protruded portion or a curved portion. Furthermore, each of the smaller diameter portions p and q does not have to be perpendicular to the bottom surface of the corresponding one of the holes 92*a*, 92*b*, 92*c*, and 92*d*, and may be inclined thereto.

In the above-described embodiment, the strengthening tabs 131 and 132 are inserted into the right and left end portions of the housing 70; however, the strengthening tabs 131 and 132 do not have to be inserted. Further, each of the strengthening tabs 131 and 132 does not have to include the jags 161*a*, 161*b*, 161*c*, 161*d*, 161*e*, 161*f*, 161*g*, and 161*h*.

Furthermore, in the above-described embodiment, the second opposing portion 161B of each of the strengthening tabs 131 and 132, which portion opposes the lid 90, is provided with the jags 161*g* and 161*h*, and the strengthening tabs 131 and 132 respectively include the horizontal portions 131B and 132B, However, either one of the jags and the horizontal portion may be provided without the other. Alternatively, the structure in which neither the jags nor the horizontal portion are provided is possible.

Still further, in the above-described embodiment, the horizontal portions 131B and 132B of the respective strengthening tabs 131 and 132 are close to the lid 90 (see FIG. 8); however, the horizontal portion 131B and 132B may be in contact with the lid 90. In this case, the lid 90 is more firmly secured to the box-like body 80.

The above-described embodiment deals with the case where the pressing pins (pressing member) 4 and 5 press both of the first movable body 50 and the second movable body 60; however, the pressing member may press one of these movable bodies. For example, it is possible to adopt a structure in which each of the pressing pins 4 and 5 is positioned substantially at the center of the guide connector 3 with respect to the front/rear directions, to press the first movable body 50 only. In this case, each of the pressing pins 4 and 5 presses the portion of the first movable body 50 which portion overlaps the second movable body 60, and therefore the second movable body 60 is pressed indirectly. This causes the two movable bodies 50 and 60 to make a transition to the separated state.

As shown in FIG. 5A, in the above-described embodiment, the first movable body 50 and the second movable body 60 partially overlap each other in the right end section $R_1$ and in the left end section $L_1$. However, the two movable bodies do not have to overlap each other. For example, in these sections, the interface between the first movable body 50 and second movable body 60 may be positioned substantially at the center with respect to the front/rear directions. In this case, it is possible to press the two movable bodies 50 and 60 with the pressing pins configured to be located substantially at the center with respect to the front/rear directions. The two movable bodies may partially overlap each other in either one of the right end section and the left end section.

Furthermore, in the above-described embodiment, the first movable body 50 and the second movable body 60 of the guide connector 3 have the similar structure; however, their structures may be different from each other.

Moreover, the springs 141 and 142 are used as the biasing member in the above-described embodiment; however, the biasing member may be a member other than the springs. For example, an elastic member such as rubber may be used as the biasing member.

Further, in the above-described embodiment, the windows 153 and 154 through which the springs 141 and 142 are respectively visible are formed at the bottom of the body formed by the first movable body 50 and the second movable body 60. However, such a window may be formed through the right wall portion and/or the left wall portion of the housing of the guide connector, for example.

What is claimed is:

1. A connector comprising: a first connector and a second connector which are configured to be disposed across a substrate from each other; and a pressing member, wherein;

the first connector comprises a first housing accommodating first and second movable bodies configured to be located across a first contact from each other, the first contact extending in a direction orthogonal to the substrate, and a biasing member configured to bias the first and second movable bodies in directions away from each other;

the first and second movable bodies accommodated in the first housing are configured to make a transition from a close state to a separated state, the close state being a state in which the first and second, movable bodies are biased by the biasing member and movement of the first and second movable bodies in the directions away from each other is restricted by the first housing, the separated state being a state in which the first and second movable bodies are more distant from the second connector than in the close state and the first and second movable bodies are made more distant from each other than in the close state by the biasing member;

the first and second movable bodies define a contact insertion hole in the close state, the contact insertion hole having a smallest diameter not smaller than a diameter of the first contact and including a section whose diameter decreases toward the substrate;

the first housing includes a first accommodating member and a second accommodating member which are separable from each other, and the first housing is capable of accommodating the first and second movable bodies so that the first and second movable bodies are positioned in the close state through a process of combining the first and second accommodating members with each other;

the second connector comprises a second housing and a second contact mounted in the second housing, the second contact configured to be electrically connected to the first contact passing through the contact insertion hole and penetrating the substrate; and the pressing member is configured to press at least one of the first and second movable bodies after the first contact passes through the contact insertion hole and penetrates the substrate and after the electric connection between the first contact and the second contact is established, thereby to cause the first and movable bodies to make the transition from the close state to the separated state.

2. The connector according to claim 1, wherein the first and second accommodating members are separable from each other in the direction orthogonal to the substrate.

3. The connector according to claim 2, wherein, in the close state, the first and second movable bodies are in contact with either one of the first accommodating member and the second accommodating member.

4. The connector according to claim 1, wherein:

one member out of the first accommodating member and the second accommodating member includes a protrusion protruding toward the other member; and the other member includes a recess into which the protrusion is fitted.

5. The connector according to claim 2, wherein:

one member out of the first accommodating member and the second accommodating member includes a protrusion protruding toward the other member; and the other member include a recess info which the protrusion is fitted.

6. The connector according to claim 3, wherein:

one member out of the first accommodating member and the second accommodating member includes a protrusion protruding toward the other member; and the other member includes a recess into which the protrusion is fitted.

7. The connector according to claim 4, wherein the recess includes a smaller diameter portion which causes the recess to at least partially have a diameter shorter than an outer diameter of the protrusion before the protrusion is fitted into the recess.

8. The connector according to claim 5, wherein the recess includes a smaller diameter portion which causes the recess to at least partially have a diameter shorter than an outer diameter of the protrusion before the protrusion is fitted into the recess.

9. The connector according to claim 6, wherein the recess includes a smaller diameter portion which causes the recess to at least partially have a diameter shorter than an outer diameter of the protrusion before the protrusion is fitted into the recess.

10. The connector according to claim 7, wherein the smaller diameter portion is a plane opposing at least a part of a side circumferential surface which is a side surface of the recess.

11. The connector according to claim 8, wherein the smaller diameter portion is a plane opposing at least a part of a side circumferential surface which is a side surface of the recess.

12. The connector according to claim 9, wherein the smaller diameter portion is a plane opposing at least a part of a side circumferential surface which is a side surface of the recess.

13. The connector according to claim 1, wherein:

the first housing includes a slit formed across the first accommodating member and the second accommodating member;

the connector further comprises an insertion member inserted into the slit in the direction orthogonal to the substrate from the first accommodating member toward the second accommodating member; and the insertion member inserted into the slit includes a first pressing portion and at least one of a second pressing portion and an opposing portion, the first pressing portion pressing the second accommodating member in a direction crossing an insertion direction in which the insertion member is inserted, the second pressing portion pressing the first accommodating member in a direction crossing the insertion direction, the opposing portion opposing the first accommodating member in the insertion direction and being in contact with the first accommodating member.

14. The connector according to claim 2, wherein:

the first housing includes a slit formed across the first accommodating member and the second accommodating member;

the connector further comprises an insertion member inserted into the slit in the direction orthogonal to the substrate from the first accommodating member toward the second accommodating member; and the insertion member inserted into the slit includes a first pressing portion and at least one of a second pressing portion and an opposing portion, the first pressing portion pressing the second, accommodating member in a direction crossing an insertion direction in which the insertion member is inserted, the second pressing portion pressing the first accommodating member in a direction crossing the insertion direction, the opposing portion opposing the first accommodating member in the insertion direction and being in contact with the first accommodating member.

15. The connector according to claim 3, wherein:

the first housing includes a slit formed across the first accommodating member and the second accommodating member;

the connector further comprises an insertion member inserted into the slit in the direction orthogonal to the substrate from the first accommodating member toward the second accommodating member; and the insertion member inserted into the slit includes a first pressing portion and at least one of a second pressing portion and an opposing portion, the first pressing portion pressing the second accommodating member in a direction crossing an insertion direction in which the insertion member is inserted, the second pressing portion pressing the first accommodating member in a direction crossing the insertion direction, the opposing portion opposing the first accommodating member in the insertion direction and being in contact with the first accommodating member.

16. The connector according to claim 4, wherein:

the first housing includes a slit formed across the first accommodating member and the second accommodating member;

the connector further comprises an insertion member inserted into the slit in the direction orthogonal to the substrate from the first accommodating member toward the second accommodating member; and the insertion member inserted into the slit includes a first pressing portion and at least one of a second pressing portion and an opposing portion, the first pressing portion pressing the second accommodating member in a direction crossing an insertion direction in which the insertion member is inserted, the second pressing portion pressing the first accommodating member in a direction crossing the insertion direction, the opposing portion opposing the first accommodating member in the insertion direction and being in contact with the first accommodating member.

17. The connector according to claim 7, wherein:

the first housing includes a slit formed across the first accommodating member and the second accommodating member;

the connector further comprises an insertion member inserted into the slit in the direction orthogonal to the substrate from the first accommodating member toward the second accommodating member; and the insertion member inserted into the slit includes a first pressing portion and at least one of a second pressing portion and an opposing portion, the first pressing portion pressing the second accommodating member in a direction crossing an insertion direction in which the insertion member is inserted, the second pressing portion pressing the first accommodating member in a direction crossing the insertion direction, the opposing portion opposing the first accommodating member in the insertion direction and being in contact with the first accommodating member.

18. The connector according to claim 10, wherein:

the first housing includes a slit formed across the first accommodating member and the second accommodating member;

the connector further comprises an insertion member inserted into the slit in the direction orthogonal to the substrate from the first accommodating member toward the second accommodating member; and the insertion member inserted into the slit includes a first pressing portion and at least one of a second pressing portion and an opposing portion, the first pressing portion pressing the second accommodating member in a direction crossing an insertion direction in which the insertion member is inserted, the second pressing portion pressing the first accommodating member in a direction crossing the insertion direction, the opposing portion opposing the first accommodating member in the insertion direction and being in contact with the first accommodating member.

19. A connector comprising:

a first housing accommodating first and second movable bodies configured to be located across a first contact from each other, the first contact extending in a direction orthogonal to a substrate; and a biasing member configured to bias the first and second movable bodies in directions away from each other, wherein:

the first and second movable bodies accommodated in the first housing are configured to make a transition from a close state to a separated state, the close state being a state in which the first and second movable bodies are biased by the biasing member and movement of the first and second movable bodies in the directions away from each other is restricted by the first housing, the separated state being a state in which the first and second movable bodies are made more distant from each other than in the close state by the biasing member;

the first and second movable bodies define a contact insertion hole in the close state, the contact insertion hole having a smallest diameter not smaller than a diameter of the first contact and including a section whose diameter decreases toward the substrate;

the first housing includes a first accommodating member and a second accommodating member which are separable from each other, and the first housing is capable of accommodating the first and second movable bodies so that the first and second movable bodies are positioned in the close state through a process of combining the first and second accommodating members with each other.

* * * * *